US005722190A

United States Patent [19]

Arnold

[11] Patent Number: 5,722,190

[45] Date of Patent: Mar. 3, 1998

[54] PRIORITY BIASED LOAD SENSE HYDRAULIC SYSTEM FOR HYDRAULIC EXCAVATORS

[75] Inventor: John W. Arnold, New Philadelphia, Ohio

[73] Assignee: The Gradall Company, New Philadelphia, Ohio

[21] Appl. No.: 617,495

[22] Filed: Mar. 15, 1996

[51] Int. Cl.[6] ..... G05D 01/02

[52] U.S. Cl. ..... 37/348; 37/382; 91/516; 60/422

[58] Field of Search ..... 37/343, 382; 91/516; 60/422

[56] References Cited

U.S. PATENT DOCUMENTS

| | | | |
|---|---|---|---|
| 4,070,857 | 1/1978 | Wible | 91/516 X |
| 4,669,363 | 6/1987 | Kreth et al. | 91/516 |
| 4,705,450 | 11/1987 | Gano | 414/687 |
| 4,712,375 | 12/1987 | Kauss et al. | 91/516 X |
| 4,977,928 | 12/1990 | Smith et al. | 91/516 X |
| 5,392,539 | 2/1995 | Hirata et al. | 37/348 |
| 5,413,452 | 5/1995 | Lech et al. | 60/422 X |
| 5,446,979 | 9/1995 | Sugiyama et al. | 37/348 |
| 5,488,787 | 2/1996 | Aoyagi et al. | 37/348 |
| 5,493,950 | 2/1996 | Kim | 91/516 |
| 5,562,019 | 10/1996 | Kropp | 91/516 |

OTHER PUBLICATIONS

Growing Acceptance for Pressure Compensated Valves, by Walt Peterson, from *DIESEL PROGRESS Engines & Drives*, pp. 30–32, Mar. 1992.

Hydraulic Systems Trends (A Primer On Load Sensing Hydraulics), by Henki, P.E., from *DIESEL PROGRESS Engines & Drives*, pp. 28, 30, 32–33, Mar. 1994 issue.

*Primary Examiner*—Terry Lee Melius
*Assistant Examiner*—Victor Batson
*Attorney, Agent, or Firm*—Kirkpatrick & Lockhart LLP

[57] ABSTRACT

A priority biased load sense hydraulic system for hydraulic excavators is provided. The hydraulic system includes first and second variable flow pumps which are coupled in load sense arrangement. The first pump is coupled to a first valve bank having a first valve section having a main spool and a compensator spool having an orifice therein, a second valve section having a main spool and a compensator spool having an orifice therein, and third and fourth valve sections each having a main spool and a compensator spool. The second pump is connected to a second valve bank. The second valve bank includes a first section having a main spool and a compensator spool having an orifice. A second valve section having a main spool and a compensator spool having an orifice and a third valve section. The compensator spools in the first and second valve banks serve to prioritize hydraulic fluid flow through the valve banks thereby affectively prioritizing the hydraulic functions receiving hydraulic fluid flow.

11 Claims, 5 Drawing Sheets

PRIORITY BIASED LOAD SENSE HYDRAULIC SYSTEM FOR HYDRAULIC EXCAVATORS

BACKGROUND OF THE INVENTION

1. Field of the Invention

The present invention relates to hydraulic excavators and, in particular, to hydraulic excavators having a priority biased load sense hydraulic system.

2. Description of the Invention Background

Various forms of hydraulic excavators have been developed heretofore. In some of such excavators, the excavator includes a lower drivable chassis and an upper material handling structure pivotally supported by the lower chassis wherein all functions of such vehicle are driven by a single engine. The material handling vehicle is controllable from a main cab on the lower chassis or from an upper operator's cabin mounted on the upper structure. The single engine provides travel power as well as power to all excavator functions with all functions, including travel and implement manipulation capabilities, may be controlled from the upper operator cab. When at an excavating site and controlled from the upper cab, the main engine may drive a hydraulic pump which supplies hydraulic fluid to power the implement hydraulics and to drive a hydraulic drive motor in response to controls from the upper operator cab, as well as to provide power to drive the vehicle through one or more hydraulic motors. An example of such an excavator is disclosed in U.S. Pat. No. 4,705,450, the disclosure of which is incorporated herein by reference.

In previous systems, a hydraulic pump or pumps driven by the engine are employed to provide hydraulic fluid for as many as seven (7) functions such as moving the excavator through two (2) hydraulic drive motors, swinging the upper structure relative to the lower chassis, raising the boom, extending the boom, tilting the boom and operating the implement. In such systems, the hydraulic fluid may be all directed to a single function thereby not providing hydraulic fluid to other functions which are requested by the operator. For example while the vehicle is being propelled, insufficient hydraulic fluid may be provided for other functions such as swinging the upper structure or raising the boom.

When, in prior systems, hydraulic fluid is only provided to a single excavator function, although another function is requested, when the first function is ceased, the vehicle may quickly provide hydraulic flow to the second function thereby operating such function. However, such rapid delivery of hydraulic fluid to previously requested, but not enabled, functions may come at a time when movement is not expected by the operator. Moreover, such systems may cause the hydraulic excavator to have decreased performance by only permitting operation of one hydraulic function at a time. Applicant has found that, in order to increase productivity of hydraulic excavators, it is desirable to provide for the simultaneous operation of multiple excavator functions such as swinging the upper structure while lifting the boom.

In order to provide hydraulic fluid under sufficient pressure to several functions, it is desirable to provide variable hydraulic pressure at high flow rates, e.g., 3,000 psi at 25 gallons per minute. To enable multiple hydraulic functions to be performed simultaneously, prioritization of the functions is necessary. Although the multiple functions may each be powered by a separate pump, various problems arise from such a design. For example, such a design may cause the hydraulic pumps to exceed the horsepower of the engine thereby stalling the engine. Also, the cost and weight of separate pumps is excessive because equipment cost and fuel economy are concerns which must be addressed. Further, the complexity of that design is disadvantageous from construction and maintenance standpoints.

The subject invention is directed toward an improved hydraulic excavator hydraulic circuit which overcomes, among others, the above-discussed problems and provides a hydraulic excavator which is of simplified design, but yet is effective to simultaneously perform multiple excavator functions and thereby enhance productivity of the hydraulic excavator.

SUMMARY OF THE INVENTION

In accordance with the present invention, there is provided a hydraulic circuit for a hydraulic excavator which affords priority to the various excavator functions. The hydraulic excavator includes a lower chassis having a pair of drive tracks, each driven by a hydraulic motor. A relatively movable upper structure is pivotally mounted on the lower chassis and includes an operator's cab thereon. Also mounted on the upper structure are an engine and a boom. The boom may be extended, raised or lowered, tilted or pivoted about its axis, and includes a material handling implement, such as a bucket, which may be opened or closed.

The engine of the excavator drives a two section variable flow hydraulic piston pump which provides hydraulic fluid under pressure for all excavator functions. One section of the pump provides hydraulic fluid to a first bank of priority biased valves. The first set of valves provides pressurized hydraulic fluid to one of the crawler motors and includes an orifice for permitting hydraulic fluid to be shared with subsequent valve sections under predetermined conditions. A second valve section in the first bank provides hydraulic fluid to the swing motor for pivoting the upper structure on the lower chassis. This section also includes an orificed valve for providing hydraulic fluid under pressure to subsequent valve sections, again under predetermined conditions. The next valve section in the first bank provides hydraulic fluid to the telescoping cylinder of the boom, while the final valve section provides hydraulic fluid to the hydraulic motor providing the boom tilt function.

The second valve bank section powered by the second hydraulic pump provides hydraulic fluid first to the second crawler motor on the chassis. The first valve in the second valve bank contains an orifice for providing hydraulic fluid under predetermined conditions to subsequent valve sections. The second valve section provides hydraulic fluid to the boom hoist cylinder under predetermined conditions and also includes an orificed valve for controlling flow to the next valve section. Further, the final valve section provides hydraulic fluid under pressure to the tool manipulation cylinder.

In the operation of the present invention, hydraulic fluid is provided by the first pump section to the first valve bank and by the second pump to the second valve bank. The respective pumps are coupled to maximize the output of the respective pumps while limiting horsepower required. The hydraulic fluid provided by the first pump to the first valve bank provides fluid first to the first section thereof which controls the first drive motor. If sufficient hydraulic flow and pressure are available to meet the needs of the first valve section, the excess hydraulic fluid passes to the remaining valve sections in the first valve bank for controlling the swing motor, boom telescope cylinder and the boom tilt motor. However, if the pressure required by the first valve section exceeds the lowest pressure requested by the remaining valve sections in the first valve bank, the flow from the first valve section is shared with the succeeding sections. If the flow available is less than that required by the first valve section and the pressure required by that section is less than that required by other sections, all hydraulic fluid will be provided to the first valve section. Prioritization of hydraulic fluid flow in this nature is also effected by the second set of valves in the first valve bank relative to the succeeding sections. Furthermore, prioritization of fluid flow in the second valve bank is similarly provided, first to the first section controlling the second drive motor, then to the second and the third sections for the hoist cylinder and the tool cylinder, respectively.

Accordingly, the present invention provides solutions to the problems associated with the simultaneous operation of various functions of hydraulic excavators. These and other details, objects and advantages of the invention become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENTS

Figure 1:
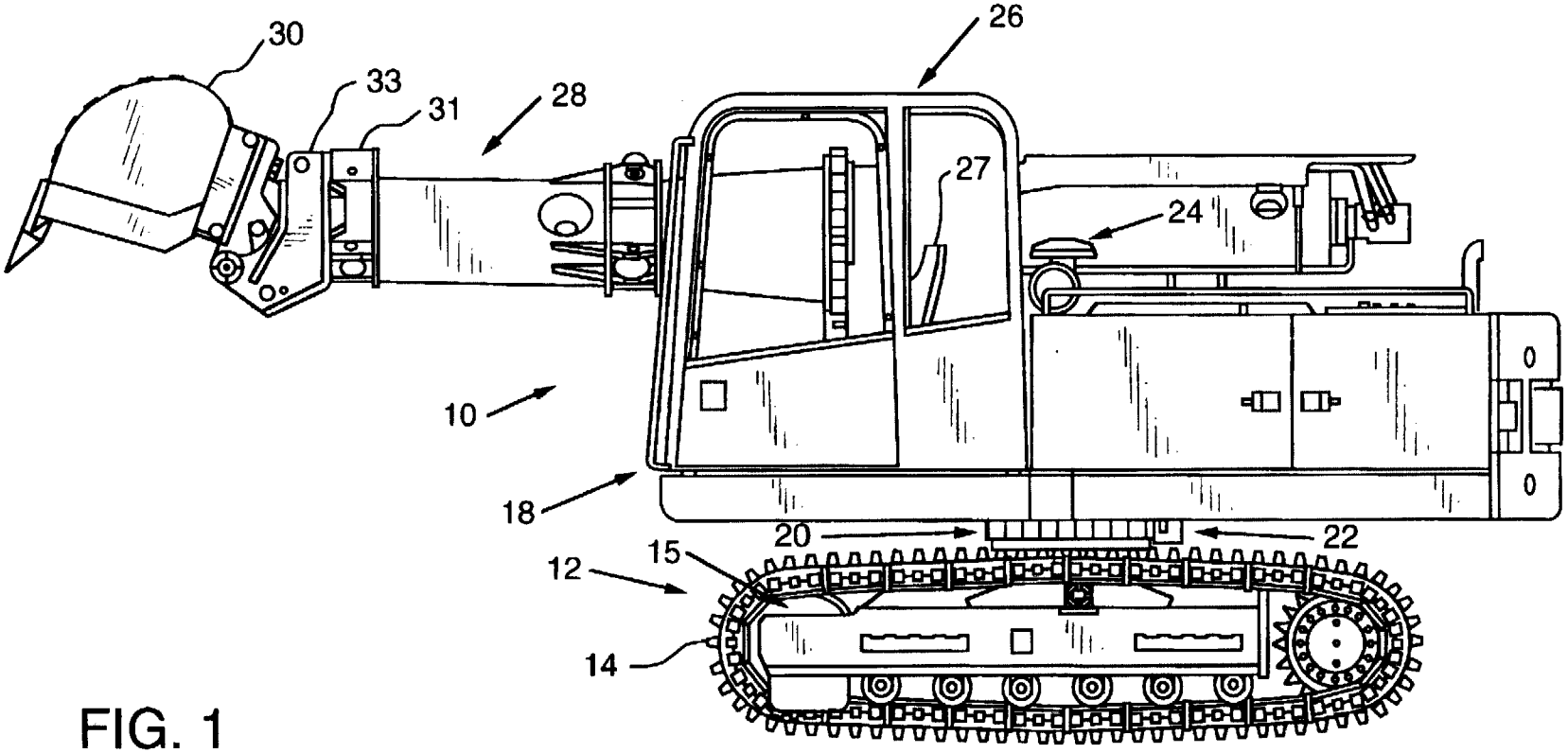
FIG. 1 is a left side elevation view of an excavator according to the present invention.
Figure 2:
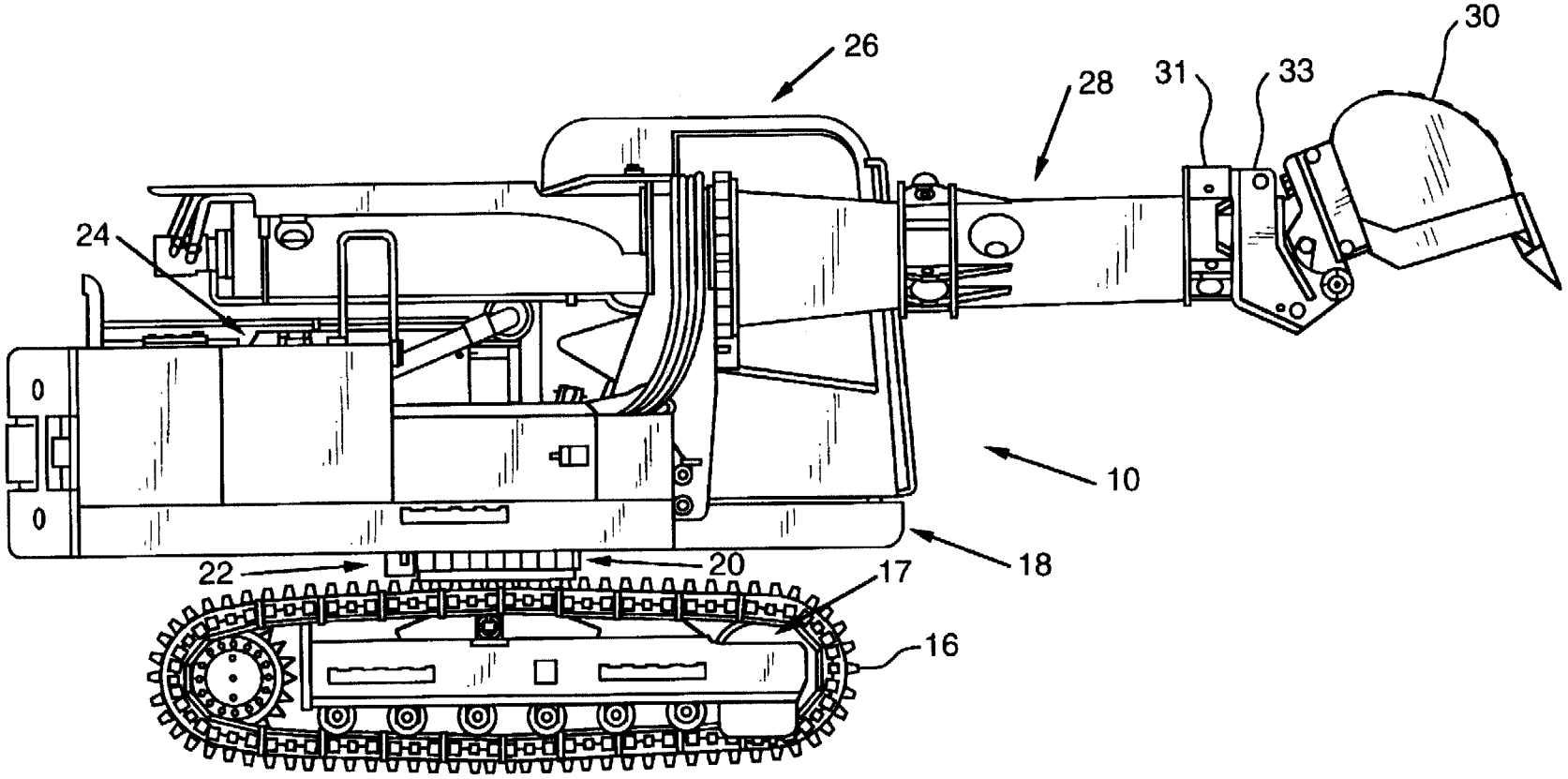
FIG. 2 is a right side elevation view of an excavator according to this invention.
Figure 3:
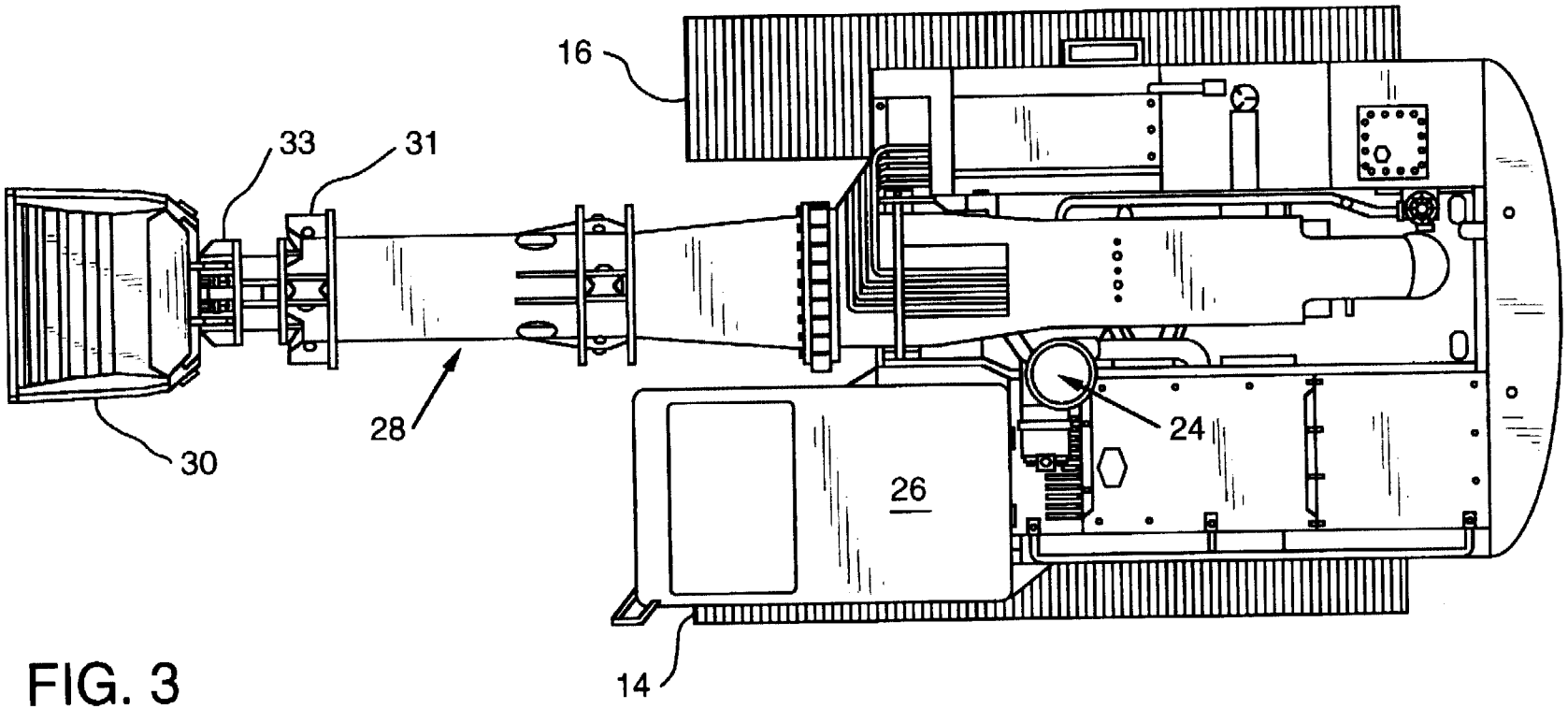
FIG. 3 is a top view of an excavator according to the present invention.
Figure 4:
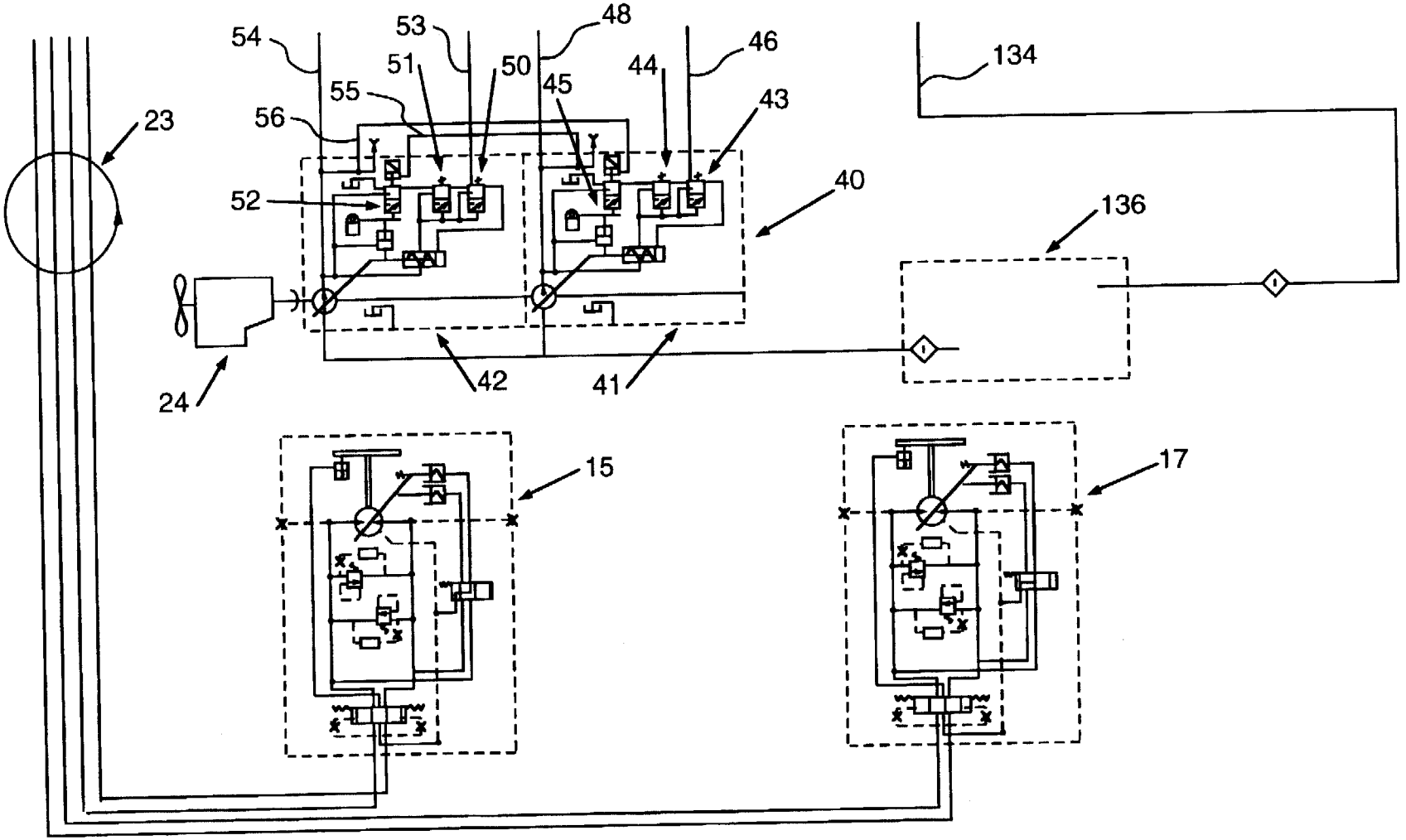
FIG. 4 is the first sheet of a schematic drawing of the hydraulic circuit of the hydraulic excavator according to the present invention.
Figure 5:
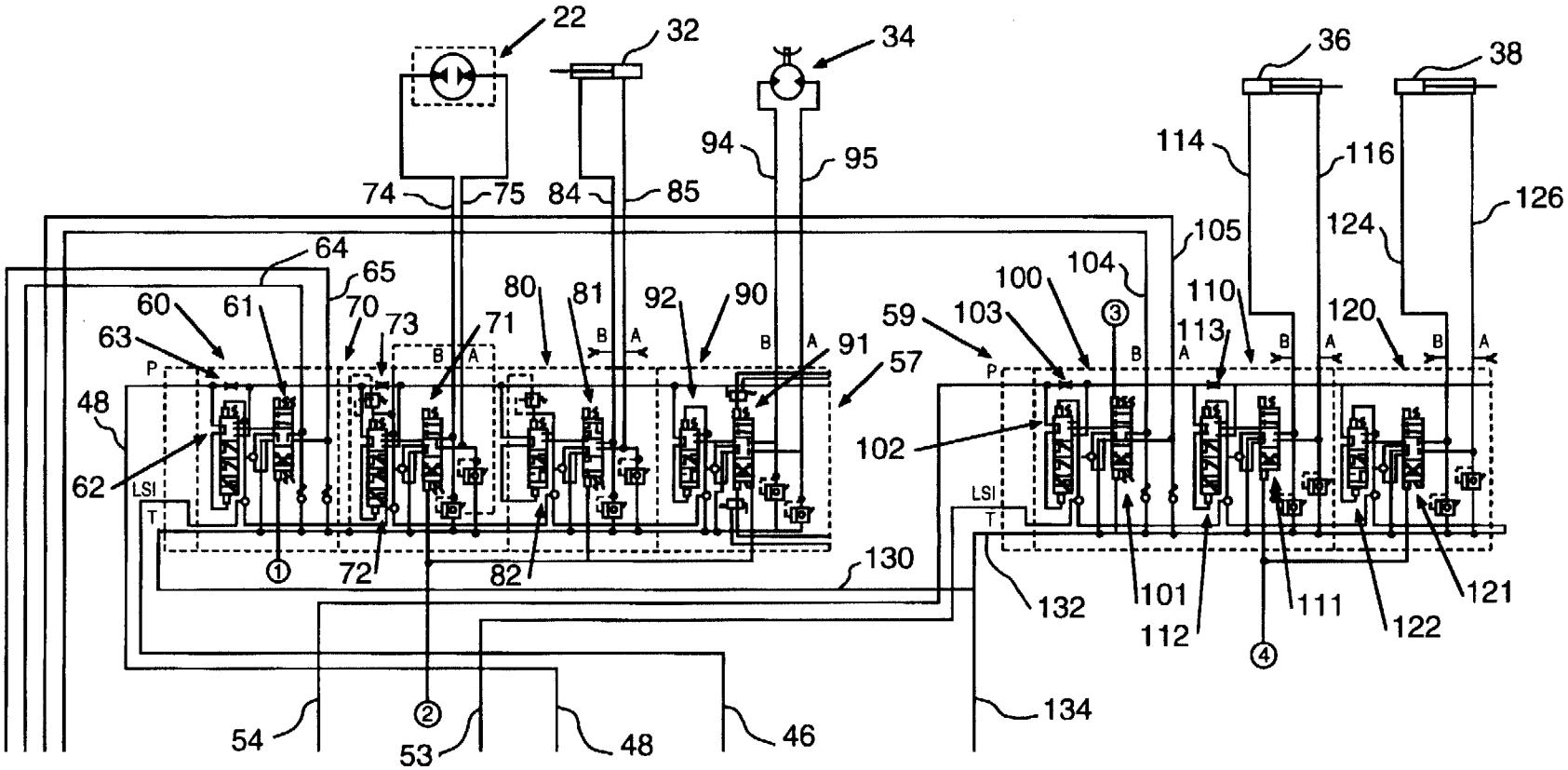
FIG. 5 is the second sheet of a schematic drawing of the hydraulic circuit of the present invention.

Referring now to the drawings where the showings are for purposes of illustrating the present preferred embodiments of the invention only and not for purposes of limiting the same, the figures show a hydraulic excavator generally designated as 10.

More particularly and with reference to FIG. 1, there is shown a hydraulic excavator 10 having a lower chassis designated as 12. Lower chassis 12 operably supports a left crawler track assembly, generally designated 14, which is driven by a hydraulic crawler motor, generally designated 15. Also provided on the lower chassis 12 is a right crawler track assembly 16 which is powered by a hydraulic crawler motor, generally designated as 17. The hydraulic motors are preferably two speed hydraulic motors which include integral brakes and brake valves. Such motor assemblies are sold by KYB of America under model number MAG 85-1500.

The lower chassis 12 supports an upper structure, generally designated as 18. The upper structure 18 is rotatably pivotable relative to the lower chassis 12 by means of a swing gear 20 mounted on the lower chassis which is engaged by a hydraulic swing motor 22 and corresponding gears mounted on the upper structure 18. Hydraulic communication between upper structure 18 and lower structure 12 are provided through a hydraulic center pin generally designated as 23.

The upper structure 18 also includes an engine, generally designated as 24. Engine 24 may, for example, be a 93 horsepower engine such as that manufactured by Cummins Engine Company under model number 4BT. Also included in the upper structure 18 is an operator's cab, generally designated as 26. The operator's cab 26 further includes an operator station 27. Pivotally mounted on the upper structure 18 for raising and lowering movement is a telescoping boom, generally designated as 28. The telescoping boom 28 itself includes a second boom section 33 that is telescopingly supported by a first boom section 31. It will also be appreciated that boom 28 may alternatively be a backhoe boom. The remote end of the telescoping boom 28 includes a movable material handling implement or tool such as a bucket 30.

Reference will now be made to the hydraulic circuitry for the control of the various movement functions of the excavator 10. The engine 24 is operably connected to a two pump assembly, generally designated as 40. The pump assembly 40 includes first and second pressure compensated, variable displacement pumps 41 and 42, respectively. The pressure compensated, variable displacement pumps are capable of changing their respective output flows by changing the displacement of the pumps in response to a load sense pilot pressure by means known to those skilled in the art. Preferably pumps 41 and 42 are such as those manufactured by Rexroth Mobile Hydraulics under model number AA11. First pump 41 includes a load sense control 43, a high pressure cutoff control 44 and a power control 45. A first load sense line 46 is connected to the load sense control 43. The output of first pump 41 is via a first high pressure line 48.

The second pump 42 includes a load sense control 50, a high pressure cutoff control 51 and a power control 52. A second load sense line 53 is connected to second load sense control 50. A second high pressure hydraulic line 54 is connected to the output of second pump 42.

Generally stated, the first pump 41 is connected to a first multisection valve bank 57 by means of first high pressure line 48 and first load sense line 46. Similarly, the second pump 42 is connected to a second multisection valve bank 59 by means of second high pressure line 54 and second load sense line 53. In the operation of the present invention, however, the pumps 41 and 42 are of the same relative priority to one another and the first valve bank 57 and the second valve bank 59 are of the same relative priority to one another. The load sense lines 46 and 53 communicate between their corresponding pumps, 41 and 42, respectively, and their corresponding valve banks 57 and 59, respectively, to sense the flow and pressure requirements in the respective valve banks and to signal the respective pumps to satisfy the valve banks' flow and pressure requirements. When the pumps 41 and 42 meet their respective horsepower limits (43 horsepower) and pressure limits (4000 psi) all valve sections in valve banks 57 and 59 will not receive their full requested flow and pressure. In that case, the valve sections in the respective valve banks will receive hydraulic fluid according to the prioritization described below.

The first valve section 57 is also connected to a tank line 130 while the second valve section is connected to a second tank line 132. Tank lines 130 and 132, respectively, are coupled to a common tank line 134 which is operatively connected to a reservoir, generally designated as 136.

The first valve bank 57 includes a first valve section generally designated as 60 (controlling crawler motor 17), a second valve section generally designated as 70 (controlling the swing motor 22), a third valve section generally designated as 80 (controlling the boom telescope cylinder 32), and a fourth valve section generally designated as 90 (controlling the boom tilt motor 34). First valve section 60 includes a main spool 61 which is operatively connected to a first operator control mechanism 1 such as a first pedal. First valve section 60 also includes a compensator spool 62 and a first orifice 63. As such, the compensator spool 62 is connected to the first high pressure line 48 on both sides of the orifice 63. The compensator spool 62 is also connected to the main spool 61 and to the load sense line 46. The main spool 61 is, in turn, connected to load sense line 46 and to hydraulic output lines 64 and 65, respectively, as well as to tank line 130. As such, the stroke of main spool 61 creates the demand for pressurized hydraulic fluid and the compensator spool 62 senses such demand as well as other demands in the load sense line 46 and provides hydraulic fluid to main spool 61 on a prioritized basis. Output lines 64 and 65 are connected through the center pin 23 to the hydraulic crawler motor 17. Pressurized hydraulic fluid flow through lines 64 and 65 cause rotation of the hydraulic motor 17 in both forward and reverse directions, respectively.

Hydraulic fluid passing from first valve section 60 of first valve bank 57 to second valve section 70 along high pressure line 48 enters second valve section 70. Second valve section 70 includes a main spool 71 which may be operated by, for example, a second operator control device 2 such as a first joystick in the operator cab. Second main spool 71 is also connected to a second compensator spool 72 which includes an orifice 73. Second compensator spool 72 is connected to each side of orifice 73 along high pressure line 48. Second compensator spool 72 is also connected to load sense line 46. The output of second compensator spool 72 is also coupled to the second main spool 71 which, in turn, is connected to the load sense line 46. The output of main spool 71 is coupled to hydraulic lines 74 and 75 which are connected to swing motor 22 to cause it to rotate forward and backward, thereby causing the upper structure 18 to swing relative to lower chassis 12. The second main spool 71 is also connected to load sense line 46. Thus, the stroke of main spool 71 creates the demand for pressurized hydraulic fluid and the compensator spool 72 senses such demand as well as other demands in the load sense line 46 and provides hydraulic fluid on a priority basis.

The hydraulic fluid which passes along high pressure line 48 through orifice 73 passes into third section 80 of first valve bank 57. Third valve section 80 includes a main spool 81 which may also be operated by the second operator control device 2. Third valve section 80 also includes a compensator spool 82. Compensator spool 82 is connected to the third main spool 81 and to load sense line 46. The main spool 81 is connected to the load sense line 46. Further, the hydraulic output of third compensator spool 82 passes through third main spool 81 into hydraulic lines 84 and 85, respectively, and to tank line 130. As such, the stroke of main spool 81 creates the demand for high pressure hydraulic fluid and the compensator spool 82 senses such demand, as well as other demands in load sense line 46 and provides hydraulic fluid on a priority basis. Hydraulic lines 84 and 85 are connected to the piston and rod sides of the boom telescope cylinder 32.

First valve bank 57 also includes a fourth valve section 90. Fourth valve section 90 includes a main spool 91 which may be connected to an additional operator control such as an electrical switch on the second operator control device 2. Fourth compensator spool is connected to the fourth main spool 91 and to load sense line 46. The main spool 91 is also connected to the load sense line 46. Additionally, fourth compensator spool 92 controls hydraulic fluid flow through fourth main spool 91 to hydraulic lines 94 and 95, respectively. Therefore, the stroke of main spool 91 creates the demand for high pressure hydraulic fluid and the compensator spool 92 senses such demand, as well as other demands in loan sense line 46, and provides hydraulic fluid on a priority basis. Hydraulic lines 94 and 95 may be connected to the opposite sides of a boom tilt motor 34.

Briefly stated, therefore, pressurized hydraulic fluid which passes through high pressure line 48 through first orifice 63 in first valve section 60 (for crawler motor 17) will continue to second valve section 70 (for swing motor 22). Hydraulic fluid which passes along high pressure line 48 through orifice 73 will continue into sections 80 (for telescope cylinder 32) and 90 (for tilt motor 34) for use therein.

Second valve bank 59 includes first valve section 100, second valve section 110 and third valve section 120. First valve section 100 includes a first main spool 101 which is connected to an operator control in the operator cab 26 such as a third operator control device 3 such as a second pedal. First valve section 100 also includes a first compensator spool 102 which includes an orifice 103. Compensator spool 102 is connected to both sides of the orifice 103 along high pressure line 54. Second compensator spool 102 is also connected to load sense line 53. The hydraulic output of first compensator spool 102 is connected to first main spool 101 which, in turn, is coupled to high pressure lines 104 and 105, respectively. The main spool 101 is also connected to the load sense line 53 and to the tank line 132. As such, the stroke of main spool 101 creates the demand for high pressure hydraulic fluid and the compensator spool 102 senses such demand, as well as other demands in load sense line 53, and provides hydraulic fluid on a priority basis. Hydraulic lines 104 and 105 are connected through the center pin 23 to the second hydraulic crawler motor 15 to cause it to rotate either forward or backward and thereby drive track 16 correspondingly.

The hydraulic fluid passing along high pressure line 54 through orifice 103 passes into second valve section 110. Second valve section 110 includes a second main spool 111, which is connected to a fourth operator control 4 such as the second joystick, and a second compensator spool 112 which, in turn, includes an orifice 113. Second compensator spool 112 is connected to both sides of the orifice 113 along high pressure line 54. Second compensator spool 112 and second main spool 111 are also coupled to the load sense line 53. The hydraulic output from second compensator spool 112 passes into second main spool 111 which, in turn, is coupled to hydraulic lines 114 and 116 which are connected to boom hoist cylinder 36. The stroke of the main spool 111 creates the demand for high pressure hydraulic fluid and the compensator spool 112 senses such demand, as well as other demands in load sense line 53 and provides hydraulic fluid on a priority basis.

Hydraulic fluid flowing through orifice 113 along line 54 passes into third valve section 120. Valve section 120 includes a third main spool 121 and a third compensator spool 122. Compensator spool 122 and third main spool 121 are connected to the load sense line 53. The hydraulic output from compensator spool 122 is connected to main spool 121 which may also be controlled by the fourth operator control device 4. Third compensator spool 121 is connected to hydraulic output lines 124 and 126, respectively, which are coupled to a tool manipulation cylinder 38.

In the operation of the hydraulic excavator according to the present invention, the variable flow hydraulic pumps 41 and 42 receive signals from load sense lines 46 and 53, respectively. The pumps 41 and 42 are connected to one another via hydraulic lines 55 and 56 to maximize the power produced thereby. If the power requirement of pump 42 is high and the pressure of pump 41 is high, then pump 42 is caused to destroke to cause the combined horsepower consumed to be less than or equal to the available engine 24 power. Conversely, if the power requirement of pump 41 is high and the pressure of 42 is high, then the control circuitry causes pump 41 to be destroked to cause the combined horsepower consumed to be less than or equal to the available engine 24 power.

The first and second valve banks 57 and 59, respectively, serve to control the respective hydraulic functions coupled thereto so as to enable them to provide hydraulic fluid to the hydraulic apparatuses attached thereto simultaneously, but with prioritization. I have found that it is by providing orifices 63 and 73 in first valve bank 57 and orifices 103 and 113 in second valve bank 59 which enables such prioritization to be accomplished. That is, the respective orifices cause the flow downstream from them to be less than actually needed by the succeeding hydraulic functions. This causes more flow to be directed to the upstream, higher priority functions, namely crawler motor 17 and swing motor 22 in first valve bank 57, and crawler motor 15 and hoist cylinder 36 in second valve bank 59.

In operation, the first compensator spool 62 hydraulically senses the pressure and flow requirements created by first main spool 61, second main spool 71, third main spool 81 and fourth main spool 91. The prioritization of the hydraulic functions in first valve bank 57 operates as follows. If the hydraulic pressure required in first valve section 60 (for crawler motor 17) exceeds the lowest pressure required in sections 70 (for swing motor 22), 80 (for telescope cylinder 32) or 90 (for boom tilt motor 34), and the hydraulic fluid flow available in line 48 is less than that required in section 60 for crawler motor 17, first compensator spool 62 operates in conjunction with first orifice 63 to cause hydraulic fluid to be provided through first spool 61 as well as permitting fluid flow through orifice 63 to sections 70, 80 and 90, such that the hydraulic fluid flow is shared therewith for the swing motor 22, telescope cylinder 32 and tilt motor 34, respectively. Also, if the hydraulic pressure required in section 60 exceeds the least pressure required in sections 70, 80 or 90, respectively, and the flow available exceeds that required by section 60, hydraulic fluid is provided both through first main spool 61 and through high pressure line 48 to sections 70, 80 and 90, respectively. However, if the hydraulic fluid flow needed in section 60 is less than the lowest hydraulic pressure required in sections 70, 80 or 90, and the flow available is less than that required by section 60, section 60 (for crawler motor 17) will receive all of the available hydraulic fluid in line 48. If, on the other hand, the hydraulic pressure required in section 60 is less than the lowest hydraulic pressure required in sections 70, 80 and 90, and the flow available exceeds that required in section 60, section 60 receives the hydraulic fluid requested and the excess flows to sections 70, 80 and 90.

The second compensator spool 72 cooperates with orifice 73 to operate in a similar manner. That is, with respect to the hydraulic fluid in high pressure line 48 entering second valve section 70 (for the swing motor 22), if the pressure required by a second valve section 70 exceeds the lowest pressure required by sections 80 (for telescope cylinder 32) or 90 (for tilt motor 34), and the flow available is less than that required by section 70 section 70 shares the flow with sections 80 and 90. Also, if the pressure required in section 70 is greater than the lowest pressure required in sections 80 and 90 and the flow available exceeds that required in section 70, section 70 will share flow with sections 80 and 90. If, instead, the pressure required in section 70 is less than the lowest pressure required in sections 80 or 90, but the flow available is less than that required by section 70, section 70 will utilize the entire hydraulic flow available to it with none proceeding to sections 80 and 90. Alternatively, if the pressure required in section 70 is less than the lowest pressure required in sections 80 and 90 and the flow available exceeds that required by section 70, the flow needs of section 70 will be satisfied and the excess will pass to sections 80 and 90

The hydraulic fluid entering section 80 (for the telescope cylinder 32) will not be prioritized with respect to section 90 (for the tilt motor 34). That is, with respect to flow entering section 80, the section among sections 80 and 90 requiring the lowest pressure will receive the hydraulic flow with the remainder, if any, passing to the other section.

The operation of second valve bank 59 is similar to that of first valve section 57. The first compensator spool 102 in first valve section 100 (for crawler motor 15) of second valve bank 59 operates to sense the pressure and flow requirements in sections 110 (for hoist cylinder 36) and 120 (for tool cylinder 38) respectively. In operation, if the pressure required in first section 100 exceeds the least pressure required in sections 110 or 120 and the flow available is less than that required in section 100, by virtue of compensator spool 102 and orifice 103, the flow will be shared between section 100 on the one hand and sections 110 and 120 on the other, thereby providing hydraulic fluid both to the hydraulic motor 15 and to the hoist cylinder 36 and the tool cylinder 38, depending on their respective demands. If the pressure required in section 100 exceeds the lowest pressure required in sections 110 and 120, and the flow available exceeds that needed in section 100, the flow will be shared with sections 110 and 120. On the other hand, if the pressure required in section 100 is a less than the lowest pressure required in sections 110 and 120 and the flow is less than that required in section 100, all flow will be utilized in section 100, thereby passing to hydraulic motor 15. If, however, the pressure required in section 100 is less than the pressure required in the least of sections 110 and 120, but the flow exceeds that required in section 100, the hydraulic fluid requirements of section 100 will be met and the excess will pass to sections 110 and 120.

The second compensator spool 112 will also sense its relative pressure and flow requirements relative to that of section 120 and receive priority by virtue of orifice 113. That is, if the pressure required in section 110 is greater than that required in 120, but the flow available is less than that required in section 110, the flow will be shared between sections 110 and 120. If the pressure required in section 110 exceeds that in 120, but the flow is greater than that required in section 110, the flow will again be shared between sections 110 and 120. If the pressure required in section 110 is less than that required in section 120, but the flow available is less than that required by section 110, all flow will be utilized in section 110 to pass to the hoist cylinder 36 through lines 114 and 116. If the flow required in section 110 is less than that required in section 120, but the flow is greater than that required in section 120, the needs of section 110 will be met and the excess will pass to section 120.

Therefore, the present invention provides prioritization of hydraulic functions of the first valve bank 57 as follows (in decreasing order of priority): crawler motor 17; swing motor 22; the telescope cylinder 32 and the tilt motor 34 are of equal priority. Prioritization in the second valve bank 59 is as follows: crawler motor 15; hoist cylinder 36; then tool cylinder 38. By virtue of the hydraulic system of the present invention, prioritization of hydraulic functions is accomplished by a less expensive, less complicated and more efficient design.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. A hydraulic excavator, comprising:

a. a chassis operably supporting:
(1) first ground engaging means;
(2) first hydraulic drive means for driving said first ground engaging means;
(3) second ground engaging means;
(4) second hydraulic drive means for driving said second ground engaging means;

b. an upper structure pivotally supported on said chassis;

c. an engine mounted on said upper structure;

d. a boom movably mounted at one end on said upper structure, said boom having at least one additional movable section;

e. a material handling implement movably mounted on the other end of said boom;

f. means for pivoting said upper structure relative to said chassis;

g. means for moving said movable section;

h. means for raising and lowering said boom; and i. a hydraulic circuit, comprising:
(1) a first hydraulic pump coupled to said engine;
(2) a first hydraulic valve in fluid communication with said first hydraulic pump and coupled to said first hydraulic drive means;
(3) a second hydraulic valve in fluid communication with said first hydraulic pump and coupled to said means for pivoting;
(4) a third hydraulic valve in fluid communication with said first hydraulic pump and coupled to said means for moving said movable section;
(5) first means for prioritizing flow of hydraulic fluid from said first pump between said first hydraulic drive means and said means for pivoting;
(6) second means for prioritizing flow of hydraulic fluid from said first pump between said means for pivoting and said means for moving said movable section;
(7) a fourth hydraulic valve in fluid communication with said second hydraulic pump and coupled to said second hydraulic drive means;
(8) a fifth hydraulic valve in fluid communication with said second hydraulic pump and coupled to said means for raising and lowering; and
(9) third means for prioritizing flow of hydraulic fluid from said second pump between said second hydraulic drive means and said means for raising and lowering.

2. The hydraulic excavator of claim 1 further comprising:

a. means for tilting said boom about its longitudinal axis;

b. means for moving said material handling implement relative to said boom; and c. said hydraulic circuit further comprises:
(1) a sixth hydraulic valve in fluid communication with said first hydraulic pump and coupled to said means for tilting, and said second means for prioritizing flow of hydraulic fluid from said first pump prioritizes flow between said means for pivoting and said means for tilting;
(2) a seventh hydraulic valve in fluid communication with said second hydraulic pump and coupled to said means for moving said implement;
(3) fourth means for prioritizing flow of hydraulic fluid from said second pump between said means for raising and lowering and said means for moving said implement.

3. The hydraulic excavator of claim 2 wherein said fourth means for prioritizing comprises a fourth restricting orifice between said fifth hydraulic valve and said seventh hydraulic valve.

4. The hydraulic excavator of claim 2 wherein:

a. said first means for prioritizing comprises a first flow restricting orifice between said first hydraulic valve and said second hydraulic valve;

b. said second means for prioritizing comprises a second flow restricting orifice between said second hydraulic valve and said third hydraulic valve;

c. said third means for prioritizing comprises a third flow restricting orifice between said fourth hydraulic valve and said fifth hydraulic valve; and d. said fourth means for prioritizing comprises a fourth flow restricting orifice between said fifth hydraulic valve and said seventh hydraulic valve.

5. The hydraulic excavator of claim 4 further comprising:

a. an operator station on said upper structure;

b. first operator control device at said operator station coupled to said first valve;

c. a second operator control device at said operator station coupled to said second valve, said third valve and said sixth valve;

d. a third operator control at said operator station coupled to said fourth valve; and e. a fourth operator control device at said operator station coupled to said fifth and seventh valves.

6. The hydraulic excavator of claim 5 wherein said boom comprises a first boom section movably mounted on said upper structure and a second boom section telescopingly supported by said first boom section.

7. The hydraulic excavator of claim 2 further comprising:

a. an operator station on said upper structure;

b. first operator control device at said operator station coupled to said first valve;

c. a second operator control device at said operator station coupled to said second valve, said third valve and said sixth valve;

d. a third operator control at said operator station coupled to said fourth valve; and e. a fourth operator control device at said operator station coupled to said fifth and seventh valves.

8. The hydraulic excavator of claim 1 wherein said first means for prioritizing comprises a first flow restricting orifice between said first hydraulic valve and said second hydraulic valve.

9. The hydraulic excavator of claim 8 wherein said second means for prioritizing comprises a second flow restricting orifice between said second hydraulic valve and said third hydraulic valve.

10. The hydraulic excavator of claim 9 wherein said third means for prioritizing comprises a third flow restricting orifice between said fourth hydraulic valve and said fifth hydraulic valve.

11. The hydraulic excavator of claim 1 wherein said boom comprises a first boom section movably mounted on said upper structure and a second boom section telescopingly supported by said first boom section.

* * * * *